United States Patent [19]

Obata et al.

[11] 4,177,976

[45] Dec. 11, 1979

[54] TUYERE FOR A MELTING FURNACE

[75] Inventors: Hiroshi Obata; Takehisa Hasegawa; Hideto Watanabe, all of Kurashiki; Kiyohiro Ikegawa, Nara; Toshiyuki Ashida, Matsubara, all of Japan

[73] Assignees: Kawasaki Steel Corporation, Kobe; Kurimoto Iron Works, Ltd., Osaka, both of Japan

[21] Appl. No.: 924,383

[22] Filed: Jul. 13, 1978

[51] Int. Cl.[2] ..... C21B 7/16

[52] U.S. Cl. ..... 266/266; 266/270; 122/6.6

[58] Field of Search ..... 110/182.5; 122/6.6; 266/189, 266, 270

[56] References Cited

U.S. PATENT DOCUMENTS 3,826,479 7/1974 Ikegawa ..... 266/270

*Primary Examiner*—Gerald A. Dost

*Attorney, Agent, or Firm*—Blanchard, Flynn, Thiel, Boutell & Tanis

[57] ABSTRACT

A tuyere for a melting furnace, which comprises inner and outer walls forming a water cooling space therebetween; a cylindrical intermediate wall dividing the water cooling space into an inner water cooling chamber and an outer water cooling chamber, whereby the cooling water is first introduced into the outer water cooling chamber from the outside of the furnace, circulated into the inner water cooling chamber from the inner end portion at the furnace side of the outer water cooling chamber and thereafter discharged from the outer end portion of the inner water cooling chamber; and a guide wall disposed in the outer water cooling chamber so as to form a helical passage for the cooling water, said helical passage being so devised that a portion of the passage located so as to be subjected to a relatively high heat load has a cross-sectional area smaller than that of other portions of the same.

3 Claims, 5 Drawing Figures

TUYERE FOR A MELTING FURNACE

BACKGROUND OF THE INVENTION

The present invention relates to a tuyere for a melting furnace, especially for a blast furnace.

Among tuyeres of this kind known heretofore, there is one disclosed in U.S. Pat. No. 3,826,479, which is devised such that, with a view to not only improving the melting resistance of the tuyere, especially the melting resistance of the fore end portion thereof, but also maintaining a high temperature of the hot blast which is sent therein, the water cooling chamber formed in between the inner and outer walls is divided into an inner water cooling chamber and an outer water cooling chamber by means of an intermediate wall disposed therein, a guide wall is provided in at least the outer water cooling chamber so as to form a helical passage, whereby the cooling water is forcibly introduced into the outer water cooling chamber, led to the inner water cooling chamber thereafter, and then discharged from the inner water cooling chamber.

However, a tuyere of this type has the drawback that a portion such as the upper part of the tuyere is subjected to a relatively high heat load due to molten pig iron, etc. (hereinafter called "high heat load portion") compared with other portions and it is difficult to prevent damage caused by the melting effectively.

In order to eliminate this drawback, therefore, it is conceivable to impart a high velocity to the current of cooling water running through the helical passage. On this occasion, however, the head loss of the cooling water increases almost in proportion to the square of the velocity of the current, and accordingly, in order to increase the velocity of the current throughout the helical passage, the cooling equipment should be a large size which would require bulky equipment and further entail an increase in the cost of operation thereof.

SUMMARY OF THE INVENTION

Therefore, the present invention is intended to provide a tuyere which can overcome the afore mentioned defects of tuyeres in the prior art.

That is, it is an object of the present invention to provide a tuyere for a melting furnace which is devised such that the sectional area of the high heat load portion of the helical passage formed within the outer water cooling chamber is smaller than that of other portions of the helical passage and the velocity of the cooling water flowing through said portion of the passage is caused to be higher than that of the cooling water flowing through other portions of the passage, thereby rendering it possible to cool the high heat load portion more effectively than other portions and check the occurrence of damages thereon due to the melting earlier than other portions.

It is another object of the present invention to provide a tuyere for a melting furnace, in which the sectional area of the high heat load portion of the helical passage is exclusively lessened, thereby drastically alleviating the head loss of the cooling water at the time of flowing through other portions of the helical passage and reducing the sectional area of the entire passage, and provision of an over-sized cooling equipment and increase in the cost of operation involved in circulating the cooling water at high speed can be averted.

It is a further object of the present invention to provide a tuyere for a melting furnace, in which the intermediate wall is of a cylindrical structure having a circular section, the central longitudinal axis thereof is offset toward the high heat load side relative to the central longitudinal axis of said outer and inner walls, thereby lessening the sectional area of the helical passage of the high heat load side and rendering it possible to make the velocity of the current of cooling water at this portion of the passage higher than that in other portions.

It is a still further object of the present invention to provide a tuyere for a melting furnace, in which said intermediate wall is of a cylindrical structure having a non-circular section, and the outer surface of a portion of said wall is disposed closer to the inner surface of the high heat load side of said outer wall, thereby lessening the sectional area of the helical passage at this portion and rendering it possible to make the velocity of the current of cooling water in this passage higher than that in other passages.

It is still another object of the present invention to provide a tuyere for a melting furnace, in which said intermediate wall is of a cylindrical structure having a non-uniform wall thickness, that is, having a relatively thick portion and a relatively thin portion, said relatively thick portion is disposed on the side of the high heat load portion, and the space between the confronting surfaces of these two portions is made to be narrower than that of other portions, thereby lessening the sectional area of the helical passage at this portion and rendering it possible to make the velocity of the current of cooling water at this portion of the passage higher than that in other passages.

DETAILED DESCRIPTION OF THE INVENTION

Figure 1:
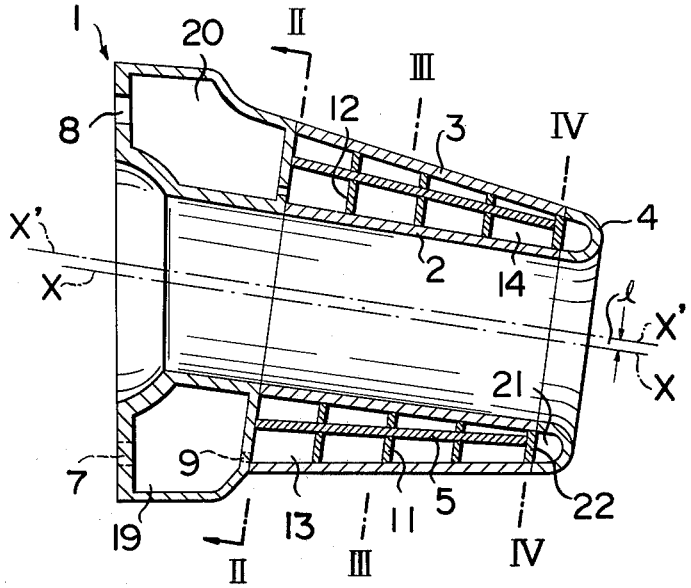
FIG. 1 is a longitudinal sectional view of an embodiment of the present invention.

In FIG. 1, the reference numeral 1 denotes a hollow annular base member, and to the front wall thereof (namely, the right side wall in FIG. 1) are fixed one end surface of both a cylindrical inner wall 2 whose central longitudinal axis is indicated by the line X—X and a tapered cylindrical outer wall 3. To the other end surface of said inner wall 2 and outer wall 3 is fixed an annular end wall 4 having a U-shaped cross-section, and said base member 1, inner wall 2, outer wall 3 and end wall 4 form a space in which is inserted and fixed a tapered cylindrical intermediate wall 5 whose central longitudinal axis is indicated by the line X'—X' said line X'—X' being offset upwardly from the the X—X by a distance l. Along the outer side and the inner side of the intermediate wall 5 are formed an outer water cooling chamber and an inner water cooling chamber, respectively, and onto the fore end of the intermediate wall 5 is fixed an annular partition 22. In between this partition 22 and the foregoing end wall 4 is formed an annular passage 21.

Figure 2:
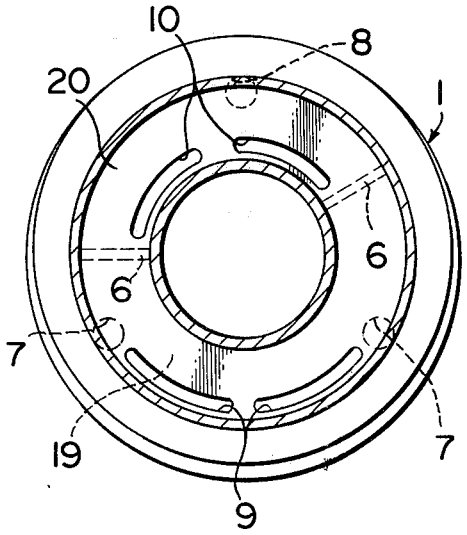
FIG. 2 is a sectional view taken along the line II—II of FIG. 1.
Figure 3:
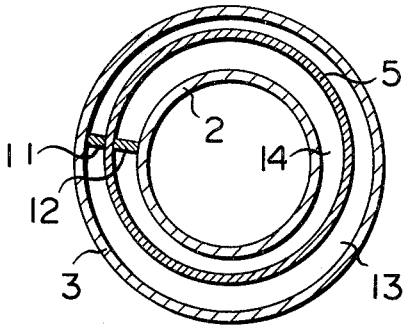
FIG. 3 is a sectional view taken along the line III—III of FIG. 1.
Figure 4:
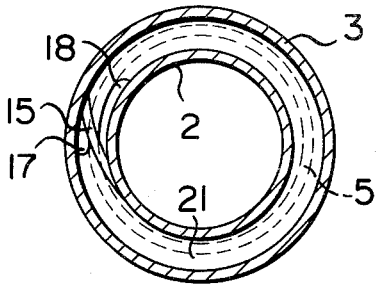
FIG. 4 is a sectional view taken along the line IV—IV of FIG. 1.

The internal void of the base member 1 is divided into a lower chamber 19 and an upper chamber 20 by means of a pair of radial partitions 6 as illustrated in FIG. 2, and the rear end wall (namely, the left side wall in FIG. 1) is provided with inlet ports 7 for cooling water and outlet ports 8 for cooling water, while the fore end wall on the opposite side is provided with passages 9 and 10, said passages 9 and 10 being connected to the foregoing outer water cooling chamber and inner water cooling chamber, respectively.

In the outer and inner water cooling chambers are formed an outer helical passage 13 and an inner helical passage 14, respectively, by means of helical guide walls 11 and 12. In this case, because the intermediate wall 5 is offset upwardly as described above, the cross-sectional area of the outer helical passage 13 diminishes gradually from the lower part to the upper part of the passage.

A port 17 is provided on the annular partition 22 at a place corresponding to the rear end portion of the helical passage 13, and another port 18 contiguous to the radially inner side of the port 17 is provided at a place confronting the inner helical passage 14. The annular passage 21 is partitioned by an inclined partition 15 between the ports 17 and 18.

Now, referring to the circulation flow of cooling water in the above mentioned embodiment of the present invention, cooling water supplied from a feed pipe connected to the inlet ports 7 enters the lower chamber 19 of the base member 1, and then flows in the outer helical passage 13 through the passage 9 at the side wall of the lower chamber 19. In the passage 13, cooling water is swirled helically to cool the portion of the outer wall 3 which portion projects into the inside of the furnace. Then, this cooling water is directed, through the port 17, to the passage 21 to cool the end wall 4, and it flows into the inner helical passage 14 through the port 18. The cooling water after cooling the inner wall 2 while passing through the passage 14 is circulated into the upper chamber 20 within the base member 1 through the passage 10, and then is discharged from the outlet port 8 into a discharge pipe connected thereto.

In the above described circulation flow of cooling water, since the initial cold water flows through the outer helical passage 13 while cooling the outer wall 3 and thereafter passes through the inner helical passage 14, the temperature of the water for cooling the inner wall 2 is already high. Therefore, there is not any risk of the inner wall 2 being excessively cooled and the temperature of the hot blast passing through the tuyere being lowered excessively.

Further, since the sectional area of the outer helical passage 13 is lessened at the upper portion of the tuyere constituting the high heat load portion, the velocity of the cooling water passing through this portion is higher than that at the time of its passing through the helical passage 13 in the lower portion of the tuyere having a relatively large sectional area, and accordingly, the upper portion of the tuyere is more intensely cooled than other portions, whereby damage caused by the melting can be warded off.

Moreover, since the helical passage 13 of the lower portion of the tuyere has a cross-sectional area larger than that of the upper portion, pressure loss can be alleviated, thereby contributing to the reduction of the cost of equipment, the cost of operation, and so forth.

Figure 5:
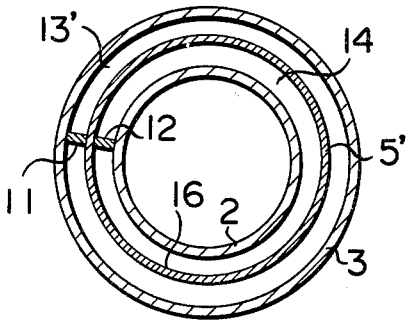
FIG. 5 is a sectional view of another embodiment as taken along the line III—III of FIG. 1.

Illustrated in FIG. 5 is another embodiment of the present invention, of which the construction is practically the same as that of the foregoing embodiment except that the intermediate wall 5' swells out toward the upper part constituting the high heat load portion and the passage 13' formed in between the outer surface of the intermediate wall 5' and the inner surface of the outer wall 3 confronting it is contracted.

As the third embodiment of the present invention, which is not illustrated herein, there can be mentioned a tuyere which is of a construction such that, in the foregoing first embodiment, the upper portion of the intermediate wall 5 is formed to be relatively thick, whereby the passage 13 corresponding to said portion is contracted.

Incidentally, although the above embodiments are illustrated to have a helical guide wall 12 disposes in the inner water cooling chamber too, it will do to omit the provision of this guide wall 12.

What is claimed is:

1. A tuyere for a melting furnace, which comprises inner and outer walls forming a water cooling space therebetween; a cylindrical intermediate wall dividing said water cooling space into an inner water cooling chamber and an outer water cooling chamber, whereby the cooling water is introduced into the outer water cooling chamber from the outside of the furnace, circulated into the inner water cooling chamber from the inner end portion at the furnace side of the outer water cooling chamber and discharged from the outer end portion of the inner water cooling chamber; a guide wall disposed at least in the outer water cooling chamber so as to form a helical passage for the cooling water; said cylindrical intermediate wall having a circular cross-section and the central longitudinal axis thereof being offset from said inner and outer walls toward the side of said outer wall which is subjected to a relatively high heat load, whereby the space between a portion of the outer surface of said intermediate wall and the inner surface of said outer wall at the high heat load side of said outer wall is narrower than the space between these surfaces at other portions of said helical passage, and the cross-sectional area of said helical passage at said high heat load side is smaller than the cross-sectional areas of said other portions of said helical passage.

2. A tuyere for a melting furnace, which comprises inner and outer walls forming a water cooling space therebetween; a cylindrical intermediate wall dividing said water cooling space into an inner water cooling chamber and an outer water cooling chamber, whereby the cooling water is introduced into the outer water cooling chamber from the outside of the furnace, circulated into the inner water cooling chamber from the inner end portion at the furnace side of the outer water cooling chamber and discharged from the outer end portion of the inner water cooling chamber; a guide wall disposed at least in the outer water cooling chamber so as to form a helical passage for the cooling water; said cylindrical intermediate wall having a non-circular cross-section and being disposed so as to make the space between a portion of the outer surface of said intermediate wall and the inner surface of said outer wall at the side of said outer wall which is subjected to a relatively high heat load narrower than the space between these surfaces at other portions of said helical passage, whereby the cross-sectional area of said helical passage at said high heat load side is smaller than the cross-sectional areas of said other portions of said helical passage.

3. A tuyere for a melting furnace, which comprises inner and outer walls forming a water cooling space therebetween; a cylindrical intermediate wall dividing said water cooling space into an inner water cooling chamber and an outer water cooling chamber, whereby the cooling water is introduced into the outer water cooling chamber from the outside of the furnace, circulated into the inner water cooling chamber from the inner end portion at the furnace side of the outer water cooling chamber and discharged from the outer end portion of the inner water cooling chamber; a guide wall disposed at least in the outer water cooling chamber so as to form a helical passage for the cooling water; said cylindrical intermediate wall having a non-uniform wall thickness formed by inner and outer cylindrical surfaces having eccentric central longitudinal axes, said intermediate wall being disposed so as to make the outer surface of a relatively thick portion of said intermediate wall confront the inner surface of said outer wall at the side of said outer wall which is subjected to a relatively high heat load and to make the space between these surfaces at said side narrower than the space between these surfaces at other portions of said helical passage, whereby the cross-sectional area of said helical passage at said high heat load side is smaller than the cross-sectional areas of said other portions of said helical passage.

* * * * *